US005487646A

United States Patent [19]

Ushitora et al.

[11] Patent Number: 5,487,646

[45] Date of Patent: Jan. 30, 1996

[54] VACUUM PUMP CONTROL APPARATUS FOR AN EVACUATING TYPE WASTE WATER COLLECTING SYSTEM

[75] Inventors: Akihiro Ushitora, Kanagawa; Kazuo Yamaguchi, Tokyo; Tsuneo Asanagi, Kanagawa, all of Japan

[73] Assignee: Ebara Corporayion, Tokyo, Japan

[21] Appl. No.: 316,715

[22] Filed: Sep. 30, 1994

Related U.S. Application Data

[63] Continuation of Ser. No. 982,085, Nov. 25, 1992, which is a continuation-in-part of Ser. No. 619,118, Nov. 28, 1990, abandoned.

[30] Foreign Application Priority Data

Nov. 30, 1989 [JP] Japan ..... 1313236

[51] Int. Cl.[6] ..... F04B 41/02; F04B 49/02

[52] U.S. Cl. ..... 417/4; 417/12; 417/36; 137/205

[58] Field of Search ..... 417/4, 5, 12, 36, 417/38, 138, 148; 137/205, 236.1

[56] References Cited

U.S. PATENT DOCUMENTS 1,447,854 5/1923 Jennings ..... 417/5

2,791,964 5/1957 Reeve ..... 417/148

*Primary Examiner*—Richard A. Bertsch
*Assistant Examiner*—Roland G. Andrews, Jr.
*Attorney, Agent, or Firm*—Jones, Day, Reavis & Pogue

[57] ABSTRACT

A vacuum pump control apparatus for an evacuating-type waste water collecting system is disclosed. In the system, waste water discharged from houses and facilities is collected into a water collecting tank by vacuum sewer pipes provided with a negative pressure therein, and the waste water collected in the water collecting tank is discharged by a booster pump while the air in the water collecting tank is discharged by a vacuum pump. The vacuum pump control apparatus comprises a gas-liquid ratio detection arrangement for detecting the ratio of the amount of air to the amount of waste water to be collected into the water collecting tank, and a control system for regulating the operating time of the vacuum pump based upon the gas-liquid ratio detected by the gas-liquid ratio detecting arrangement, so that a target value of the gas-liquid ratio is recovered when it falls below the target value. By this apparatus, the gas-liquid ratio within the vacuum sewer pipes is kept to an ideal value to thereby prevent an air lock from forming in the vacuum sewer pipes.

14 Claims, 5 Drawing Sheets

OPERATION OF BOOSTER PUMP

OPERATION OF VACUUM PUMP

VACUUM PUMP CONTROL APPARATUS FOR AN EVACUATING TYPE WASTE WATER COLLECTING SYSTEM

CROSS-REFERENCE TO RELATED APPLICATION

This is a continuation of copending application(s) Ser. No. 07/982,085 filed on Nov. 25, 1992; which is a CIP of U.S. Ser. No. 07/619,118 filed on Nov. 28, 1990, now abandoned.

BACKGROUND OF THE INVENTION

The present invention relates to an evacuating-type waste water collecting system for collecting the waste water discharged from a number of houses, and more particularly to a vacuum pump control apparatus for such a system.

An evacuating-type waste water collecting system has been known as one of the systems for collecting waste water discharged from a number of houses. FIG. 3 shows the overall structure of such an evacuating-type waste water collecting system. As shown in the figure, the waste water having been discharged from each of the houses 30 (located on the ground surface) flows into an underground cesspool 32 through sewer pipes 31 of the type utilizing a natural downflow. When a predetermined amount of waste water has collected at the lower portion of the cesspool 32, a vacuum-operated valve 33 attached at the upper portion within the cesspool 32 is opened so that the waste water in the cesspool 32 is sucked through a suction pipe 34 together with air which amounts to several times the volume of the waste water. This waste water is then sucked via the vacuum-operated valve 33 into vacuum sewer pipes 35 which are distributed beneath the ground surface, and therefore connected to a water collecting tank 1 at the vacuum pump site 40. Waste water collected in the water collecting tank 1 is then sent to a sewage treatment plant or the like by means of a booster pump 3.

To generate a negative pressure at the interior of the water collecting tank 1 and at the interior of the vacuum sewer pipes 35, a vacuum pump 2 is attached to the water collecting tank 1. Operation of the vacuum pump 2 and the booster pump 3 has conventionally been controlled in response to the gas pressure and the liquid level of the waste water in the water collecting tank 1 respectively. In other words, the vacuum pump 2 is controlled to start when the gas pressure in the water collecting tank has risen above a set value (i.e., towards atmospheric pressure) and to stop when the pressure is less than another set value. Booster pump 3, on the other hand, is controlled in such a manner that it is started when the liquid level of waste water within the water collecting tank 1 has risen above a set value, while it is stopped when the level falls below another set value.

In this type of system, generally, a two-phase flow consisting of gas and liquid occurs within the vacuum sewer pipe 35, and waste water, drawn by the force with which said gas is sucked toward the water collecting tank 1, is also carried to the water collecting tank 1. Thus, it is not possible for a specific portion of the vacuum sewer pipe 35 to be filled only with waste water.

For some unspecified reason, however, a portion of the vacuum sewer pipe 35 with an upgrade toward the vacuum pump site 40 (like portion "A" shown in FIG. 3) may be filled with waste water, causing a so-called air lock. In such a case, the negative pressure generated at the water collecting tank 1 is significantly reduced at the distal ends of the pipe passage of the vacuum sewer pipes 35 (i.e., the air pressure is raised).

When the negative pressure within the pipe is reduced in this way, the amount of air sucked from the vacuum-operated valve 33 is reduced and the gas-liquid ratio in the vacuum sewer pipe (i.e., the amount of air to the amount of the waste water) becomes smaller. In addition, since the volume of the air in the pipe becomes smaller, air locks are caused more easily, thereby resulting in a "vicious cycle" such that the negative pressure is reduced even further at the distal ends of the pipe passage.

SUMMARY OF THE INVENTION

The present invention has been achieved in view of the problems as described above, and its object is to provide a vacuum pump control apparatus for an evacuating-type waste water collecting system, which controls the operating time of a vacuum pump so that a high gas-liquid ratio within the vacuum sewer pipes is recovered when it falls below a predetermined value.

To solve the problems as described above, the present invention comprises a vacuum pump control apparatus having gas-liquid ratio detection means for detecting the ratio of the amount of air to the amount of waste water being collected in a water collecting tank of an evacuating-type waste water collecting system, and control means for controlling the operating time of the vacuum pump based upon the gas-liquid ratio detected by the gas-liquid ratio detection means, so that a target value of said gas-liquid ratio is recovered when it falls below the target value.

The following exemplary means may be employed as the gas-liquid ratio detection means:

(1) Measuring the cumulative operation time $t_1$ of the vacuum pump during a time duration with which the waste water level in the water collecting tank is changed from one known level to another known level, the gas-liquid ratio being determined on the basis of the total displacement of the vacuum pump which has been derived from the cumulative operation time and the capacity of the vacuum pump, and also on the basis of the amount of waste water in the tank from the first known level to the second known level;

(2) A gas-liquid ratio is determined on the basis of the total displacement of the vacuum pump which has been derived from the cumulative operation time during a certain time period and the capacity of the vacuum pump, and also on the basis of the total pumped out amount of the waste water which has been obtained during the cumulative operation time within the certain time period, and the pumping out capacity of the booster pump.

Furthermore, as the above-described control means, the vacuum pump is operated for a predetermined differential time period $t_2-t_1$ whenever the gas-liquid ratio detected by the gas-liquid ratio detection means falls below the target value. The variable $t_1$ constitutes the cumulative operation time of the vacuum pump during the previous operation of the vacuum pump in which the water level rose from a known level to another known level. The reference time $t_2$ is predetermined, as described below. This operation of the vacuum pump is effected in addition to the normal operation of the same.

By arranging a vacuum pump controlling apparatus of an evacuating-type waste water collecting system in a manner as described above, the vacuum pump operating time is controlled by the controlling means for a longer than normal duration when it is detected by the gas-liquid ratio detection means that the gas-liquid ratio has fallen below the target value. Air pressure in the water collecting tank thus becomes lower than that in the normal operation. Therefore, the air pressure in the vacuum sewer pipe correspondingly becomes less. As a result, the amount of air sucked from the vacuum operated valve is increased, thereby making the overall gas-liquid ratio higher. Furthermore, since the air pressure in the pipes becomes less, the air is significantly expanded to remove the air lock.

The above described objects, and other objects, features, and advantages of the present invention will become more apparent from the following description when taken in conjunction with the accompanying drawings in which a preferred embodiment of the present invention is shown by way of illustrative examples.

DETAILED DESCRIPTION OF THE PREFERRED EMBODIMENT

An embodiment of the present invention will now be described in detail with reference to the drawings.

Figure 2:
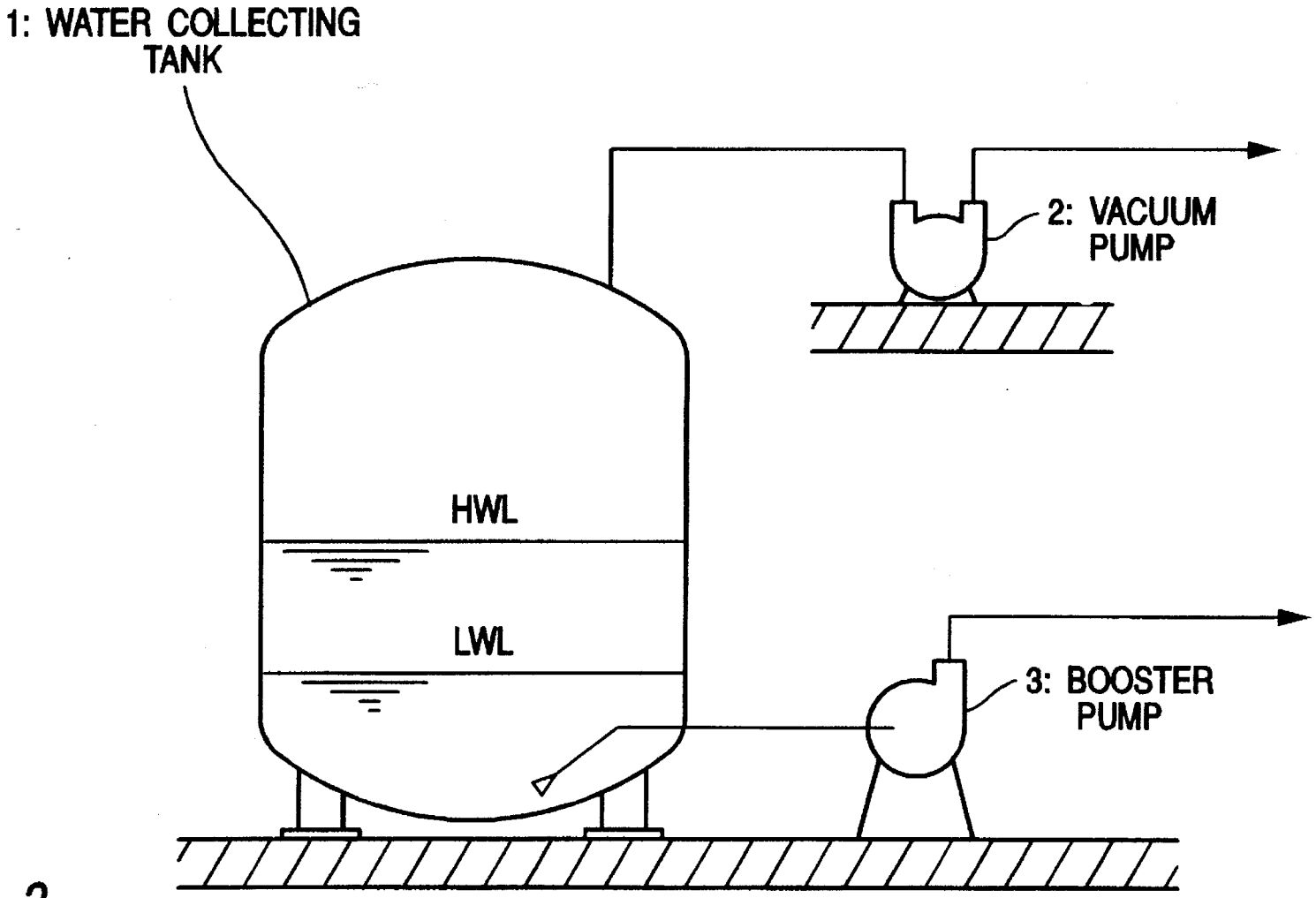
FIG. 2 is a schematic view showing a water collecting tank 1, a vacuum pump 2 and a booster pump 3 in their connected state to which the present invention may be applied.

FIG. 2 is a view illustrating a water collecting tank 1, a vacuum pump 2 and a booster pump 3 in their connected state to which the present invention may be applied. As shown in this figure, the vacuum pump 2 and the booster pump 3 are connected to the upper portion and the lower portion of the water collecting tank 1, respectively. Air in the water collecting tank is evacuated when the vacuum pump 2 is operated, while the waste water in the water collecting tank is removed when operating the booster pump 3.

Vacuum pump 2 suitably employed in this embodiment is of the type which starts when the air pressure in the water collecting tank exceeds −5.0 mAq (the atmospheric pressure is the reference), and stops when it falls below −7.0 mAq. This vacuum pump 2 is to be controlled by the vacuum pump control apparatus according to the present invention of which the controlling method will be described hereinafter.

Booster pump 3 is controlled to repeat a process that is started when the liquid level of the waste water in the collecting tank 1 reaches HWL (high water level), while it is stopped at LWL (low water level). Vacuum pump 2, on the other hand, is started whenever the air pressure in the water collecting tank 1 exceeds −5.0 mAq.

Since the air lock problem does not occur when the gas-liquid ratio is large (i.e., when the amount of air is large relative to the amount of waste water), the vacuum pump 2 is stopped in a manner similar to a conventional vacuum pump when the air pressure in the water collecting tank 1 falls below −7.0 mAq. On the other hand, when the gas-liquid ratio is small (i.e., when the amount of the air is small relative to the amount of the waste water), the vacuum pump 2 is forced to operate before being stopped, regardless of whether or not the air pressure in the water collecting tank 1 has fallen below −7.0 mAq, for a differential time $t_2-t_1$ starting from the point at which the waste water level has reached LWL, as will be explained in more detail hereinafter.

Such a reference time $t_2$ constitutes an operating time of the vacuum pump 2 which is necessary for evacuating the amount of air to be evacuated for the total amount of waste water to be accumulated from LWL to HWL in the water collecting tank 1 (i.e., the amount of air for achieving an ideal gas-liquid ratio). It is determined based upon the following formula:

$$t_2=\frac{(R)(w)\dfrac{(10.33)}{(10.33-6)}}{Q}$$

wherein:

w=the volume of waste water to be accumulated in the water collecting tank between LWL and HWL, stated in terms of m;

R=the volume ratio of air-to-waste water under atmospheric pressure (or the required minimum gas-to-liquid ratio, normally 2–3);

Q=the suction volume of the vacuum pump, stated in terms of m/min.

10.33=atmospheric pressure (absolute pressure), stated in terms of mAq.

−6=the mean suction pressure of the vacuum pump, stated in terms of mAq, derived by the formula:

$$[(-7\ mAq)+(-5\ mAq)]/2=-6\ mAq$$

Figure 3:
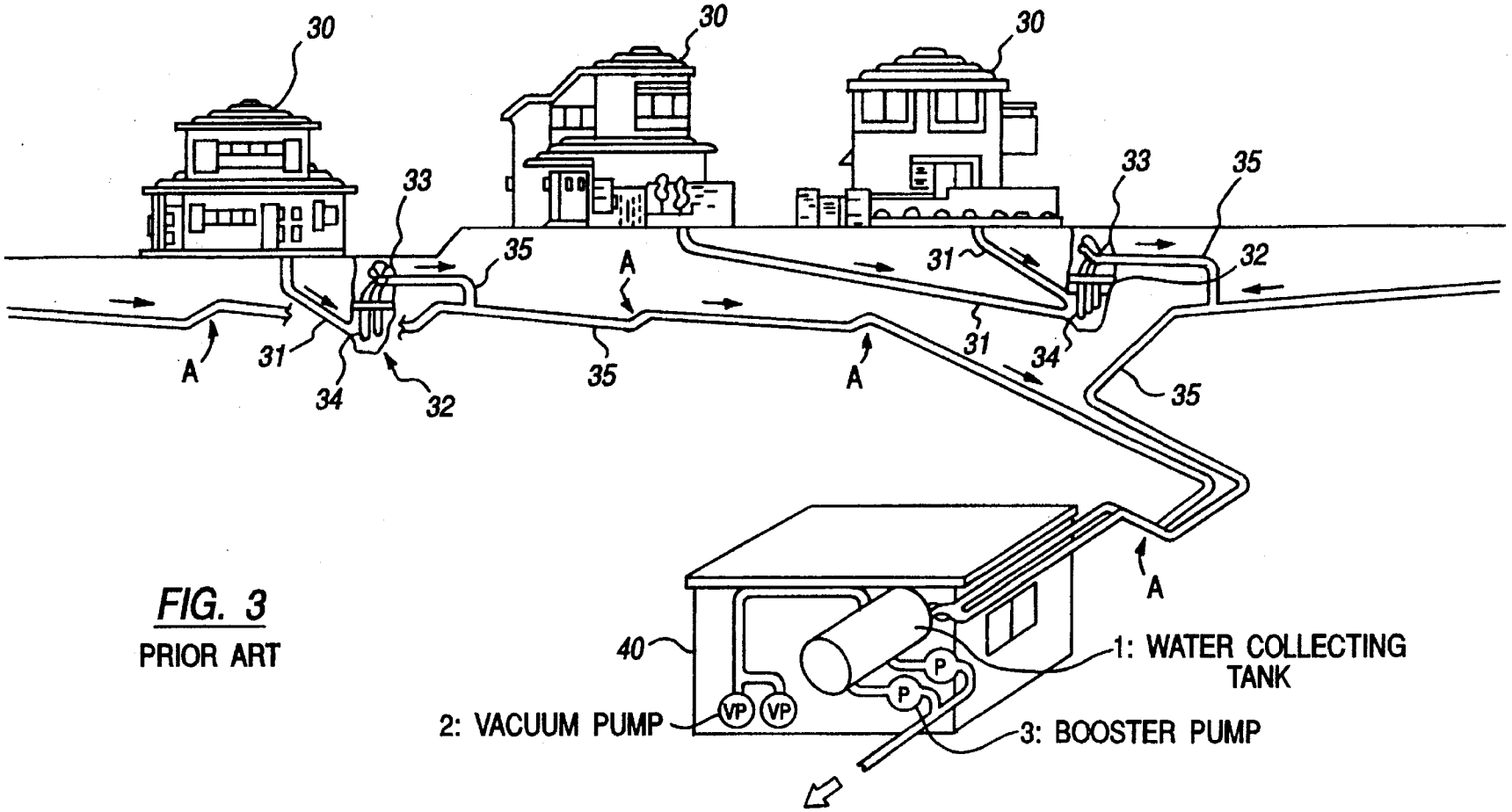
FIG. 3 PRIOR ART
FIG. 3 is a schematic view showing the overall structure of a conventional evacuating-type waste water collecting system.

Because of this reason, the air pressure in the water collecting tank 1 may be reduced below −7.0 mAq. In such a case, the air pressure within the vacuum waste water pipe 35, as shown in FIG. 3, is accordingly reduced, the apparent gas-liquid ratio within the vacuum waste water pipe 35 becomes larger, and the problem of the air lock mentioned above will be removed. Therefore, a lower air pressure reaches the location of the vacuum valve 33, whereby more air may be sucked and a higher overall gas-liquid ratio achieved. By repeating such an operation, an ideal gas-liquid ratio may be closely attained.

It should be noted that another case where the vacuum pump 2 is caused to stop is when the liquid level of the waste water in the water collecting tank 1 has reached HWL. This is to prevent the waste water from flowing into the vacuum pump 2 from the upper portion of the water collecting tank 1 due to an unusually elevated liquid level of the waste water in the water collecting tank 1.

The gas-liquid ratio as described above may be obtained from the amount of waste water collected in the water collecting tank 1 (i.e., the amount of waste water sucked from all the vacuum-operated valves 33) and from the amount of air (the air amount sucked from all the vacuum operated valves 33). In practice, the volume of the air and the volume of the waste water are derived by the following methods:

(1) Air Amount

It is possible to assume that the displacement of the vacuum pump 2 be substantially constant for a unit time. An approximated air amount evacuated from the water collecting tank 1 may therefore be obtained by calculating the cumulative operating time of the vacuum pump 2 within a certain time period.

(2) Waste Water Amount

The amount of waste water from the water level LWL to the water level HWL in the water collecting tank 1 is previously known.

In this embodiment, a cumulative operating time $t_1$ is calculated as the operating time of the vacuum pump 2 during a time duration with which the waste water within the water collecting tank 1 is increased from LWL to HWL. Based on this result, the air amount in relation to the amount of the waste water is calculated to obtain the gas-liquid ratio.

Figure 1:
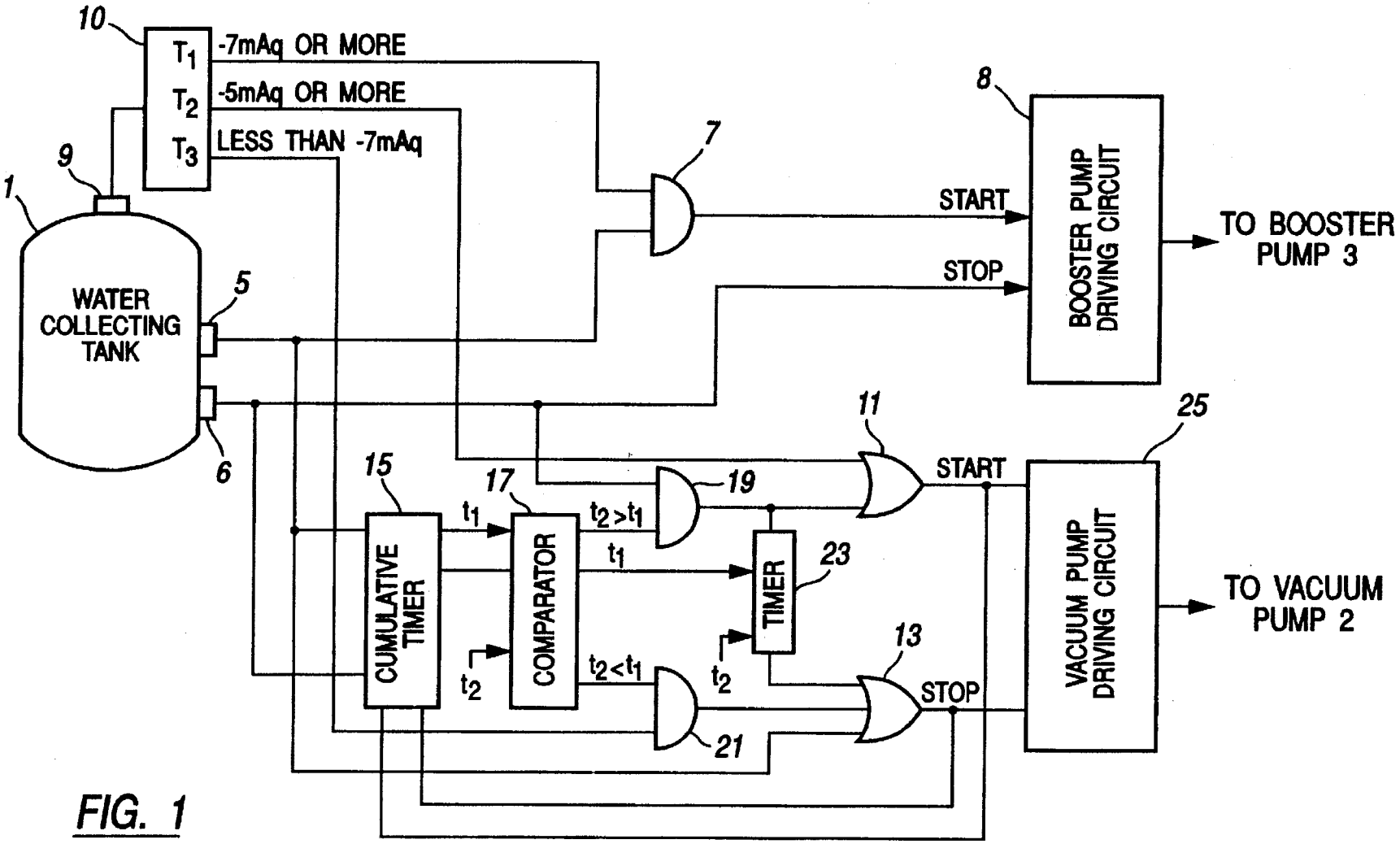
FIG. 1 is a schematic diagram showing an example of a circuit arrangement of a vacuum pump control apparatus according to the present invention.

FIG. 1 is a diagram showing an example of a circuit arrangement for implementing the above-described control method. Included in this figure are: a HWL (high water level) sensor 5 for detecting a HWL of the waste water level within the tank 1; a LWL (low water level) sensor 6 for detecting LWL; an AND circuit 7; a booster pump driving circuit 8; a pressure sensor 9 for sensing the air pressure within the water collecting tank 1; a processing circuit 10 which provides an output from an output terminal $T_1$ when the air pressure within the water collecting tank 1 has risen above −7.0 mAq, provides an output from an output terminal $T_2$ when it has risen above −5.0 mAq, and provides an output from an output terminal $T_3$ when it has fallen below −7.0 mAq; OR circuits 11, 13; AND circuits 19, 21; a cumulative timer 15 for measuring and outputting a cumulative operating time $t_1$ of the vacuum pump 2 during the time with which the waste water in the water collecting tank 1 is increased from LWL to HWL; a comparator 17 which compares the cumulative operating time $t_1$ with the reference time $t_2$ so as to provide an output to the AND circuit 19 when $t_2>t_1$ and provide an output to the AND circuit 21 when $t_2<t_1$; a timer 23 which is arranged to provide an output to the OR circuit 13 just after an elapse of the differential time period $t_2-t_1$ from the time at which an output signal from the AND circuit 19 has been entered; and a vacuum pump driving circuit 25.

Figure 4:
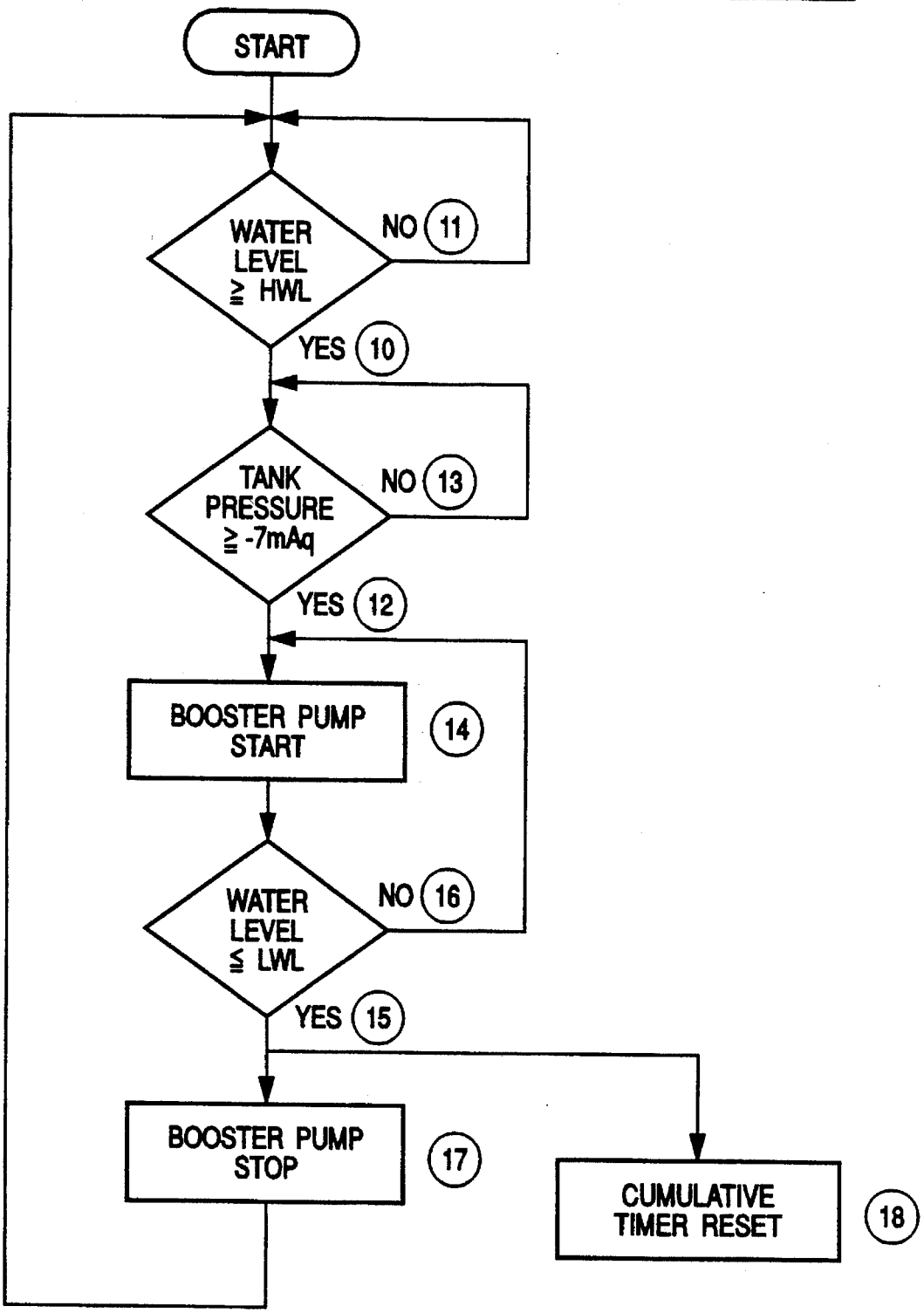
FIG. 4 is a logic flow chart, depicting the operation of the booster pump of the present invention.

First, with reference to FIGS. 1 and 4, when waste water flows into the water collecting tank 1 and its liquid level reaches HWL, a signal from the HWL sensor 5 is fed into the AND circuit 7. If the air pressure in the water collecting tank 1 is above −7.0 mAq (output from the terminal $T_1$ of the processing circuit 10) at this time, a signal is provided from the AND circuit 7 to the booster pump driving circuit 8 so as to operate the booster pump 3 (i.e., steps 10, 12, 14).

Next, when the liquid level of the waste water in the water collecting tank 1 is reduced from HWL to LWL because of the operation of the booster pump 3, a signal from the LWL sensor 6 is fed into the booster pump driving circuit 8 so as to stop the booster pump 3 (i.e., steps 15, 17). By so doing, the liquid level of the waste water within the water collecting tank 1 is raised once again to HWL, and similar operations are thereafter repeated. When the liquid level reaches LWL, the cumulative timer 15 is reset to zero and starts counting (e.g., steps 15, 18).

Figure 5:
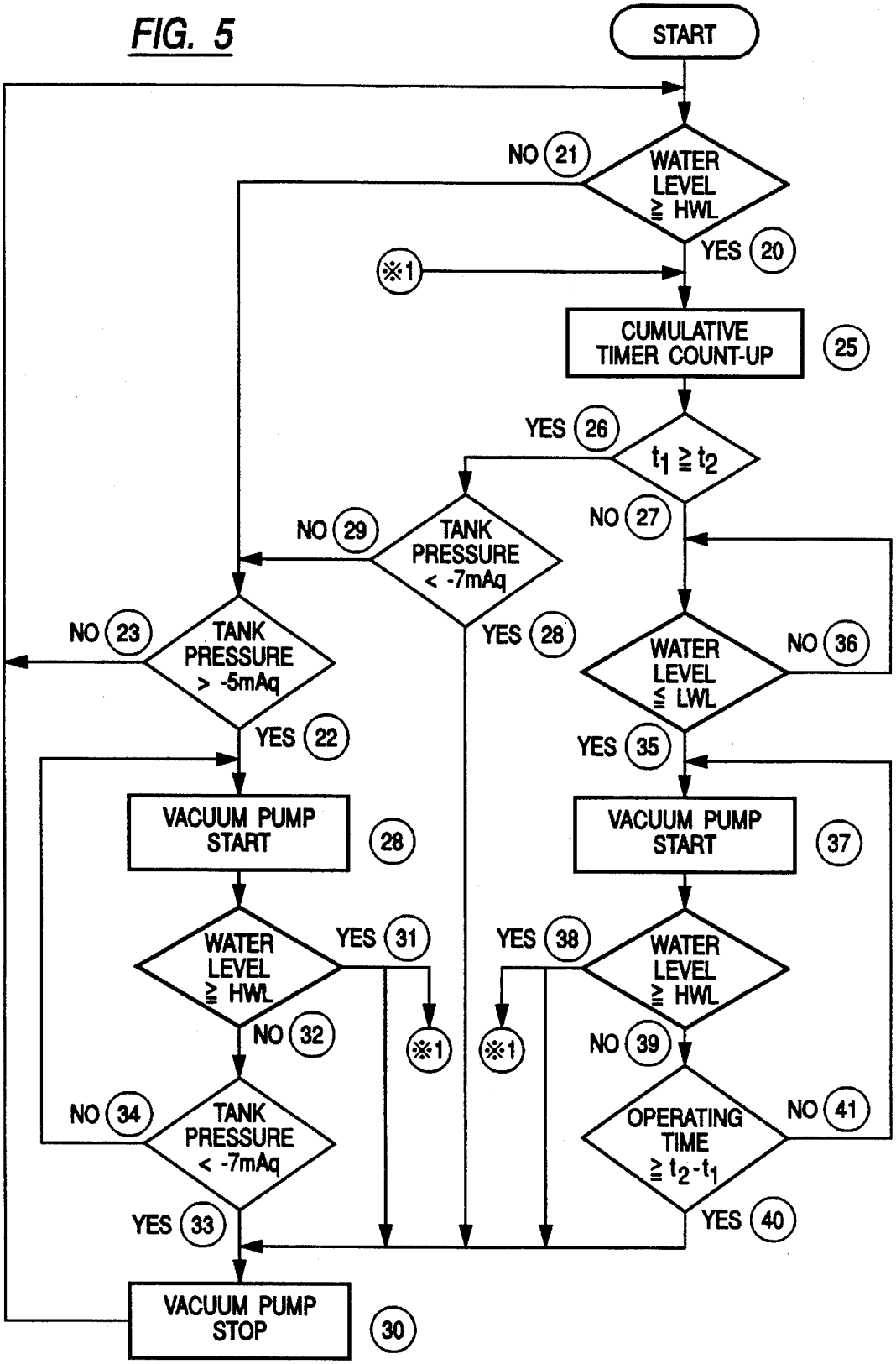
FIG. 5 is a logic flow chart, depicting the operation of the vacuum pump of the present invention.

Operation of the vacuum pump 2 will now be described according to each of the possible cases with reference to FIGS. 1 and 5. First, when the air pressure in the water collecting tank 1 has exceeded −5.0 mAq, the output from the output terminal $T_2$ of the processing circuit 10 is fed into the OR circuit 11 so as to start the vacuum pump 2 (e.g., steps 21, 22, 24).

Next, in a case where the cumulative operating time $t_1$ of the vacuum pump 2 measured by the cumulative timer 15 for the previous vacuum pump cycle is compared with the reference time $t_2$ in the comparator 17 and $t_2<t_1$ is obtained (i.e., where the gas-liquid ratio is relatively large), an output is provided from the AND circuit 21 to stop the vacuum pump 2 when the air pressure in the water collecting tank 1 has fallen below −7.0 mAq (i.e., from the output terminal $T_3$ of the processing circuit 10) (e.g., steps 25, 26, 28, 30 or 25, 26, 29, 22, 24, 32, 33, 30).

On the other hand, in a case where the cumulative operating time $t_1$ of the vacuum pump 2 is determined as $t_2>t_1$ (i.e., where the gas-liquid ratio is relatively small), the vacuum pump is started by the AND circuit 19 when the liquid level of the waste water in the water collecting tank 1 has fallen to LWL (output from the LWL sensor 6) (e.g., steps 27, 35, 37), and the vacuum pump 2 is to be stopped by the OR circuit 13 just after the differential time period $t_2-t_1$ has elapsed by the timer 23 (e.g., steps 39, 40 30). In this case, it should be noted that once the liquid level of waste water in the tank 1 rises to HWL, the booster pump 3 is driven by the signal from the AND circuit 7, thereby causing the liquid level to fall to the LWL. Also, once the vacuum pump 2 is started by the AND circuit 19, the operation of the vacuum pump 2 is continued for the differential time period $t_2-t_1$ to increase the gas-liquid ratio, regardless of whether or not the air pressure in the water collecting tank 1 is below −7.0 mAq, or the rising liquid level exceeds the LWL position.

Furthermore, as stated above, to prevent the waste water from flowing into the vacuum pump 2, when the liquid level of the waste water in the water collecting tank 1 has reached HWL, the output of the HWL sensor 5 is fed into the 0R circuit 13 so as to stop the vacuum pump 2 (e.g., steps 31, 30 or 38, 30). At the same time, the cumulative operating time $t_1$ is compared with the reference time $t_2$ to start the above-mentioned operations from step 25 (1).

It should be noted that the normal starting pressure, −5.0 mAq, of the vacuum pump 2 in the above-described embodiment is set higher than the conventional value, −6.0 mAq or −5.5 mAq. This intends that, by accepting the rise of air pressure in the water collecting tank 1 up to the −5.0 mAq as far as the predetermined gas-liquid ratio is favorably maintained, the number of operations of the vacuum pump 2 is reduced to save the amount of water.

While a specific embodiment of the vacuum pump control apparatus for an evacuating-type waste water collecting system according to the present invention has been described in detail, the present invention is not limited to this, and various modifications such as those set out below are possible.

(1) In the above-described embodiment, the operating mode of the vacuum pump 2 is controlled by calculating the gas-liquid ratio from the cumulative operating time and evacuating capacity of the vacuum pump 2 during the time within which a certain amount of waste water flows into the water collecting tank 1. The present invention is not limited to this. For example, the amount of air may be calculated from a cumulative operating time within a predetermined time period and an evacuating capacity of the vacuum pump 2, and, at the same time, the amount of waste water is calculated from the cumulative operating time within said predetermined time period and the pumping out capacity of the booster pump 3. A gas-liquid ratio may be calculated from these air and waste water amounts and the vacuum pump 2 is caused to be operated to increase the gas-liquid ratio when it falls below the target value.

(2) In the above-described embodiment, the evacuating capacity of the vacuum pump 2 is considered to be constant regardless of the suction pressure (i.e., air pressure in the water collecting tank 1). Displacement of the vacuum pump 2 was thus calculated only from its operating time. Strictly speaking, however, the evacuating capacity of the vacuum pump 2 is changed according to the suction pressure. Displacement of the vacuum pump 2 is thus obtained with respect to the suction pressure of each unit time, which is then integrated to accurately obtain the total displacement for a predetermined time interval. Vacuum pump 2 may be controlled on the basis of this result.

As has been described in detail, a vacuum pump control apparatus of an evacuating-type waste water collecting system according to the present invention is controlled such that the vacuum pump is operated for a predetermined period whenever the gas-liquid ratio has fallen below the target value. Thus the air pressure in the water collecting tank becomes lower than that under the normal condition, and the air pressure in the vacuum sewer pipes becomes correspondingly lower. As a result, the amount of air sucked from the vacuum operated valve is increased, and there is therefore an excellent advantage that the overall gas-liquid ratio is improved to an ideal value.

What is claimed is:

1. A vacuum pump control apparatus for an evacuating-type waste water collecting system in which waste water discharged from houses and facilities is transported to a water collecting tank by means of vacuum sewer pipes provided with a negative pressure therein, and in which the waste water collected in said water collecting tank is discharged by means of a booster pump while the air in said water collecting tank is discharged by means of a vacuum pump, said vacuum pump control apparatus comprising:

(a) gas-liquid ratio detection means for detecting the ratio of the amount of air to the amount of waste water to be collected into said water collecting tank; and (b) control means linked to the detecting means for controlling the operating time of said vacuum pump determined by the gas-liquid ratio detected by said gas-liquid ratio detecting means so that a target value of said gas-liquid ratio is recovered when it falls below the target value to thereby maintain the gas-liquid ratio in said vacuum sewer pipes at said target value.

2. A vacuum pump control apparatus for an evacuating-type waste water collecting system in which waste water discharged from houses and facilities is transported to a water collecting tank by means of vacuum sewer pipes provided with a negative pressure therein, and in which the waste water collected in said water collecting tank is discharged by means of a booster pump while the air in said water collecting tank is discharged by means of a vacuum pump, said vacuum pump control apparatus comprising:

(a) gas-liquid ratio detection means for detecting the ratio of the amount of air to the amount of waste water to be collected into said water collecting tank;.

(b) control means for controlling the operating time of said vacuum pump based upon the gas-liquid ratio detected by said gas-liquid ratio detecting means so that a target value of said gas-liquid ratio is recovered when it falls below the target value; and wherein said gas-liquid ratio detection means measures cumulative operating time of said vacuum pump during the time duration with which the waste water level in said waste water tank rises from one predetermined level to second predetermined level, and determines the gas-liquid ratio on the basis of the total displacement of said vacuum pump obtained from the cumulative operating time and the evacuating capacity of said vacuum pump, and on the basis of the amount of waste water contained in said waste water tank from the first predetermined level to the second predetermined level.

3. A vacuum pump control apparatus as recited in claim 2, wherein said gas-liquid ratio detection means includes a cumulative timer for measuring a cumulative operation time of said vacuum pump.

4. A vacuum pump control apparatus as recited in claim 3, wherein said control means includes a comparator for comparing said cumulative operation time of said vacuum pump with a reference time, and output means for sending a signal to start operation of said vacuum pump when said cumulative operation time is less than said reference time.

5. A vacuum pump control apparatus as recited in claim 4, wherein said control means includes a timer for limiting duration of operation of said vacuum pump to a predetermined value.

6. A vacuum pump control apparatus as recited in claim 5, further comprising a low water level sensor and a high water level sensor provided in said water collecting tank for detecting said first and second predetermined levels of said waste water in said water collecting tank, and operatively connecting them to said control means, said control means operating to stop operation of said vacuum pump when said second predetermined level is detected by said high water level sensor.

7. A vacuum pump control apparatus as recited in claim 6, further comprising a pressure sensor for sensing the air pressure within said water collecting tank, a processing circuit connected to said pressure sensor, and output means for sending a signal to said control means when the pressure within said water collecting tank has risen above a first predetermined value to thereby start the operation of said vacuum pump.

8. A vacuum pump control apparatus as recited in claim 16, wherein said first predetermined value is −5 mAq.

9. A vacuum pump control apparatus as recited in claim 6, wherein said processing circuit outputs a signal to said control means when the pressure within said water collecting tank has fallen below a second predetermined value which is lower than said first predetermined value, said control means operating to stop said vacuum pump when the pressure within said water collecting tank has fallen below said second predetermined value, and when said cumulative operation time of said vacuum pump is no longer than said reference time.

10. A vacuum pump control apparatus as recited in claim 9, wherein said second predetermined value is −7 mAq.

11. A vacuum pump control apparatus for an evacuating, type waste water collecting system in which waste water discharged from houses and facilities is transported to a water collecting tank by means of vacuum sewer pipes provided with a negative pressure therein, and in which the waste water collected in said water collecting tank is discharged by means of a booster pump while the air in said water collecting tank is discharged by means of a vacuum pump, said vacuum pump control apparatus comprising:

(a) gas-liquid ratio detection means for detecting the ratio of the amount of air to the amount of waste water to be collected into said water collecting tank;

(b) control means for controlling the operating time of said vacuum pump based upon the gas-liquid ratio detected by said gas-liquid ratio detecting means so that a target value of said gas-liquid ratio is recovered when it falls below the target value; and wherein said gas-liquid ratio detection means determines the gas-liquid ratio both on the basis of the total displacement of said vacuum pump obtained from the cumulative operating time within a certain time period and the evacuating capacity of the vacuum pump, and on the basis of the total pumped out amount obtained from the cumulative operating time within said certain time period and the pumping out capacity of the booster pump.

12. A vacuum pump control apparatus as recited in claim 11 wherein said gas-liquid ratio detection means includes a cumulative timer for measuring a cumulative operation time of said vacuum pump.

13. A vacuum pump control apparatus as recited in claim 12, wherein said control means includes a comparator for comparing said cumulative operation time of said vacuum pump with a reference time, and output means for sending a signal to start operation of said vacuum pump when said cumulative operation time is less than said reference time.

14. A vacuum pump control apparatus as recited in claim 13, wherein said control means includes a timer for limiting duration of operation of said vacuum pump to a predetermined value.

* * * * *